US008302698B2

(12) United States Patent
Giem

(10) Patent No.: US 8,302,698 B2
(45) Date of Patent: Nov. 6, 2012

(54) ACTIVATION-DEVICE LAUNCHER FOR A CEMENTING HEAD

(75) Inventor: Greg Giem, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 318 days.

(21) Appl. No.: 12/436,893

(22) Filed: May 7, 2009

(65) Prior Publication Data

US 2010/0282478 A1 Nov. 11, 2010

(51) Int. Cl.
*E21B 33/12* (2006.01)
*E21B 33/13* (2006.01)

(52) U.S. Cl. ..... 166/386; 166/291; 166/318; 166/70; 166/75.15; 166/193

(58) Field of Classification Search ..... 166/386, 166/70, 291, 82.1, 75.15, 193, 177.3, 318
See application file for complete search history.

(56) References Cited

U.S. PATENT DOCUMENTS

| | | | | |
|---|---|---|---|---|
| 3,076,509 | A * | 2/1963 | Burns et al. | 166/70 |
| 3,915,226 | A | 10/1975 | Savage | |
| 4,624,312 | A | 11/1986 | McMullin | |
| 4,703,807 | A * | 11/1987 | Weston | 166/373 |
| 5,443,122 | A | 8/1995 | Brisco | |
| 5,890,537 | A | 4/1999 | Lavaure et al. | |
| 6,182,752 | B1 * | 2/2001 | Smith et al. | 166/70 |
| 7,040,401 | B1 * | 5/2006 | McCannon | 166/250.15 |
| 2004/0055741 | A1 * | 3/2004 | Pedersen et al. | 166/70 |
| 2005/0205266 | A1 | 9/2005 | Todd et al. | |
| 2008/0060811 | A1 | 3/2008 | Bour et al. | |
| 2008/0060820 | A1 | 3/2008 | Bour et al. | |

FOREIGN PATENT DOCUMENTS

GB 2404210 1/2005

* cited by examiner

*Primary Examiner* — Cathleen Hutchins
(74) *Attorney, Agent, or Firm* — Matthias Abrell

(57) ABSTRACT

An activation-device launching system, mounted on a cementing head, allows the deployment of a combination of darts, balls, bombs, canisters in order to activate downhole equipment, launch cementing plugs, deliver chemical products, or the like. A valve controls the flow of process fluid, and holds an activation device in place until it is time for launching. The valve also has a hollow axle through which balls may be launched into the process-fluid stream at any time.

7 Claims, 12 Drawing Sheets

ACTIVATION-DEVICE LAUNCHER FOR A CEMENTING HEAD

BACKGROUND OF THE INVENTION

The statements in this section merely provide background information related to the present disclosure and may not constitute prior art.

The present invention is related in general to equipment for servicing subterranean wells. Particularly, the invention relates to a cementing head that is intended to drop a combination of darts, balls, bombs and canisters in order to activate downhole equipment, launch cementing plugs, deliver chemical products, or the like.

Tools currently available on the market for downhole services implement a modular design with darts that are preloaded in baskets within the modules. The modules are connected to one another using clamps. The darts are held in place mechanically and released by removing the mechanical obstruction and redirecting the flow of the pumped fluid (hereinafter called "process fluid") through the dart basket. The darts are then pumped through the tool by the fluid. The first dart to be launched is placed in the lowest module, with subsequent darts passing through the baskets vacated by the earlier darts.

Darts in prior designs are launched by blocking the bypass flow of the process fluid and forcing the fluid through the dart chamber. The dart forms an initial seal when placed into the basket. When fluid enters the dart chamber, pressure builds and breaks the seal, forcing the dart out of the basket, through the tool and into the main process-fluid stream.

Some prior art designs consist of modules such as those described in U.S. Pat. Nos. 4,624,312 and 5,890,537. The darts are loaded from the topmost module, through the swivel if necessary, and pushed down to their respective baskets with a long rod. The modules have valves that are used to select between the dart and the bypass flow. The valve itself serves as the mechanical obstruction that prevents the dart from prematurely launching. When the valve is turned, it simultaneously opens a passage for the dart while closing the passage of the bypass flow.

Another portion of the module is used to launch balls that flow down the well and seat within plugs. Once seated, the balls block the flow of process fluid through the plug, and the resulting pumping-pressure increase causes shear pins to rupture, releasing the plug from its seat. The ball launching portion of the module adds significant length to the cement head.

It remains desirable to provide improvements in wellsite surface equipment in efficiency, flexibility, and reliability.

SUMMARY OF THE INVENTION

The present invention allows such improvements.

In a first aspect, the present invention relates to a multiple activation-device launching system for a cementing head having a launcher body comprising a plug valve through which a process fluid and activation devices may pass, and through which balls may be launched when the plug valve is in either the main-flow or bypass-flow position.

In another aspect, the present invention aims at a plug-valve system for a cementing head that allows the deployment of balls into the process-fluid stream when the valve is in either the main-flow or bypass-flow position. In the main-flow position, balls may pass through the valve in the same manner as other activation devices, including darts, canisters and bombs. In the bypass-flow position, balls may be inserted through a passage inside the valve axle. An advantage of the dual functionality of this design is the reduction of the length of the cement-head assembly.

To allow ball deployment in either the main-flow or bypass-flow position, the valve preferably has a swept cutout through at least 90 degrees of the valve's range of motion. In addition, the valve may be fabricated as a hollow shell.

The activation devices may also contain chemical substances that, upon exiting the launching chamber, are released into the well.

In yet another aspect, the present invention pertains to a method for deploying one or more activation devices into a process-fluid system, utilizing a multiple-activation device launching system for a cementing head comprising a plug-valve that allows the deployment of balls into the process-fluid stream when the valve is in either the main-flow or bypass-flow position.

In a preferred embodiment, the method comprises pumping a process fluid through the main-flow portion of the launcher body, placing the plug valve in the main-flow position and, if desired, allowing one or more activation devices to pass. The plug valve may then be placed in the bypass-flow position, opening a passageway inside the plug-valve axle through which balls may be inserted into the process-fluid stream. After launching one or more balls, the plug-valve may be set back to the main-flow position, allowing the passage of additional activation devices. This operating sequence may be repeated until a sufficient number of activation devices have been deployed to complete the treatment.

The method may further comprise the use of activation devices that contain a chemical substance. The chemical substance is here released into the well after exiting the launching chamber.

Although the disclosed plug-valve system is mainly being presented in the context of well cementing, it will be appreciated that the process-fluid stream could comprise other well fluids including, but not limited to, drilling fluids, cement slurries, spacer fluids, chemical washes, acidizing fluids, gravel-packing fluids and scale-removal fluids.

DETAILED DESCRIPTION

When cementing the annular space between tubulars and the walls of a subterranean wellbore, it is usually necessary to minimize or prevent the commingling of the drilling fluid, spacer fluid and cement slurry. Commingling may result in adverse rheological effects, dilution of the cement slurry and compromised zonal isolation. One way to minimize commingling involves using wiper plugs to separate fluids as they travel down the tubulars. Wiper plugs also clean the inner surface of the tubulars.

Figure 1:
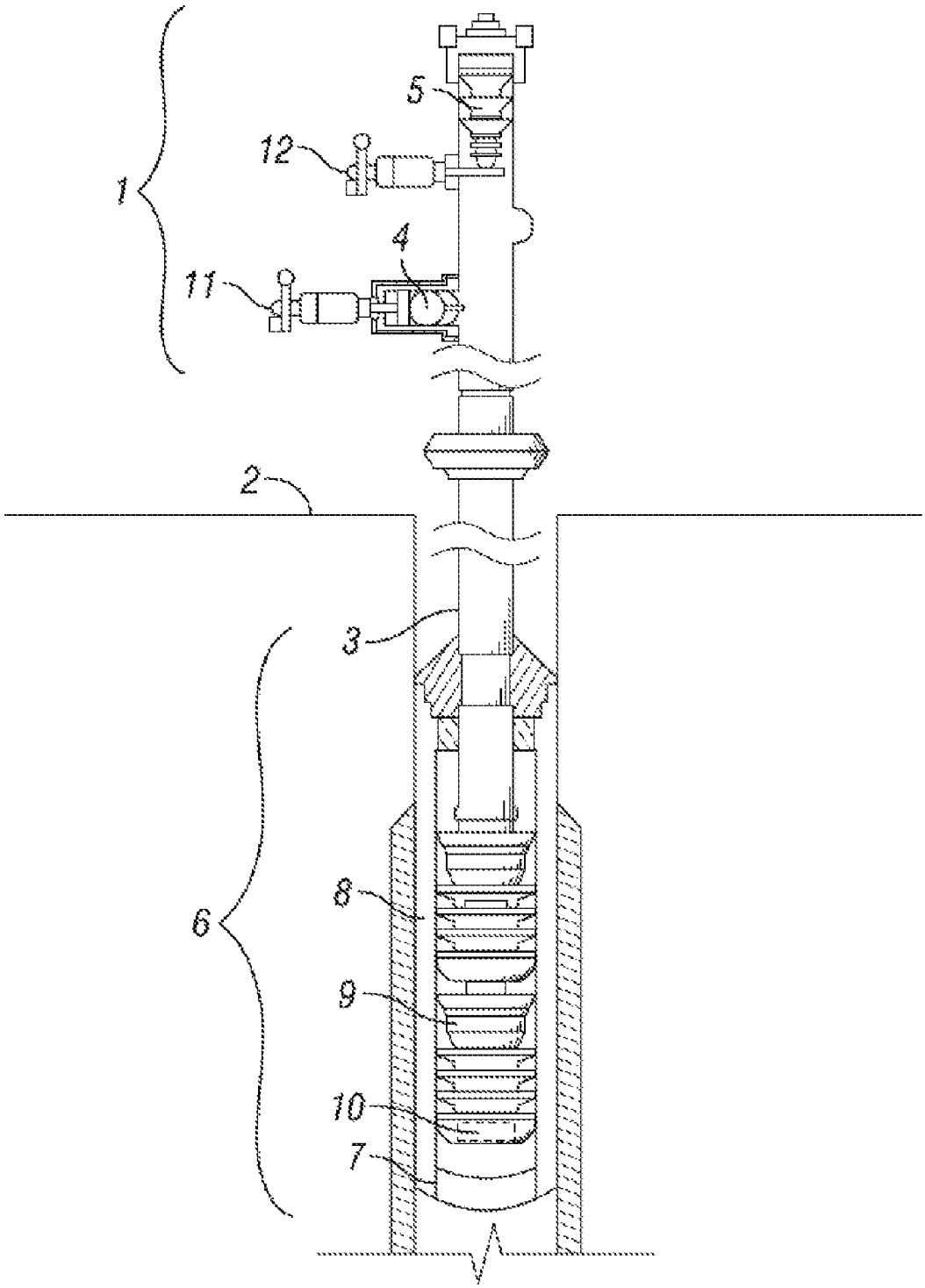
Figure 1 (PRIOR ART)
FIG. 1 is a schematic diagram depicting a conventional prior-art single-stage subsea cementing head system.

FIG. 1 depicts a conventional single-stage subsea plug launching system. The cementing head 1, located above the rig floor 2, is made up to the drillpipe 3, which serves as the casing landing string and controls the cementing plug release. The head contains a launching ball 4 and dart 5. The subsea assembly 6, partially inside the casing to be cemented 7, contains the top cementing plug 8 and the bottom cementing plug 9. Both plugs are attached to the casing wall by shear pins.

Referring to FIG. 1, the casing 7 is initially filled with drilling fluid or spacer fluid. Prior to pumping cement slurry, the bottom plug launching ball 4 is released. The ball travels down the casing, seats inside the bottom plug 9 and blocks fluid flow. The resulting pressure increase causes the shear pins to rupture, releasing the bottom plug. The bottom plug then travels down the casing and stops at the bottom. Extra pump or hydrostatic pressure extrudes the ball through its orifice seat, and cement displacement continues. A ball catcher 10 attached to the lower end of the bottom plug retains the ball.

Once the cement slurry has been pumped, the top-plug launching dart 5 is released. It seats into the body of the top cementing plug 8. Increased circulation pressure then causes the shear pins to rupture and release the top plug. The cementing operation continues. At the end of slurry displacement, the top plug stops above the bottom plug 9.

As depicted in FIG. 1, the ball-release mechanism 11 and the dart-release mechanism 12 are preferably two separate components of the cementing head. The resulting length of the cementing head can lead to ergonomic and logistical problems, particularly in remote locations. Therefore, there is an incentive to employ one release mechanism for both darts and balls, thereby reducing the length of the apparatus.

Figure 2:
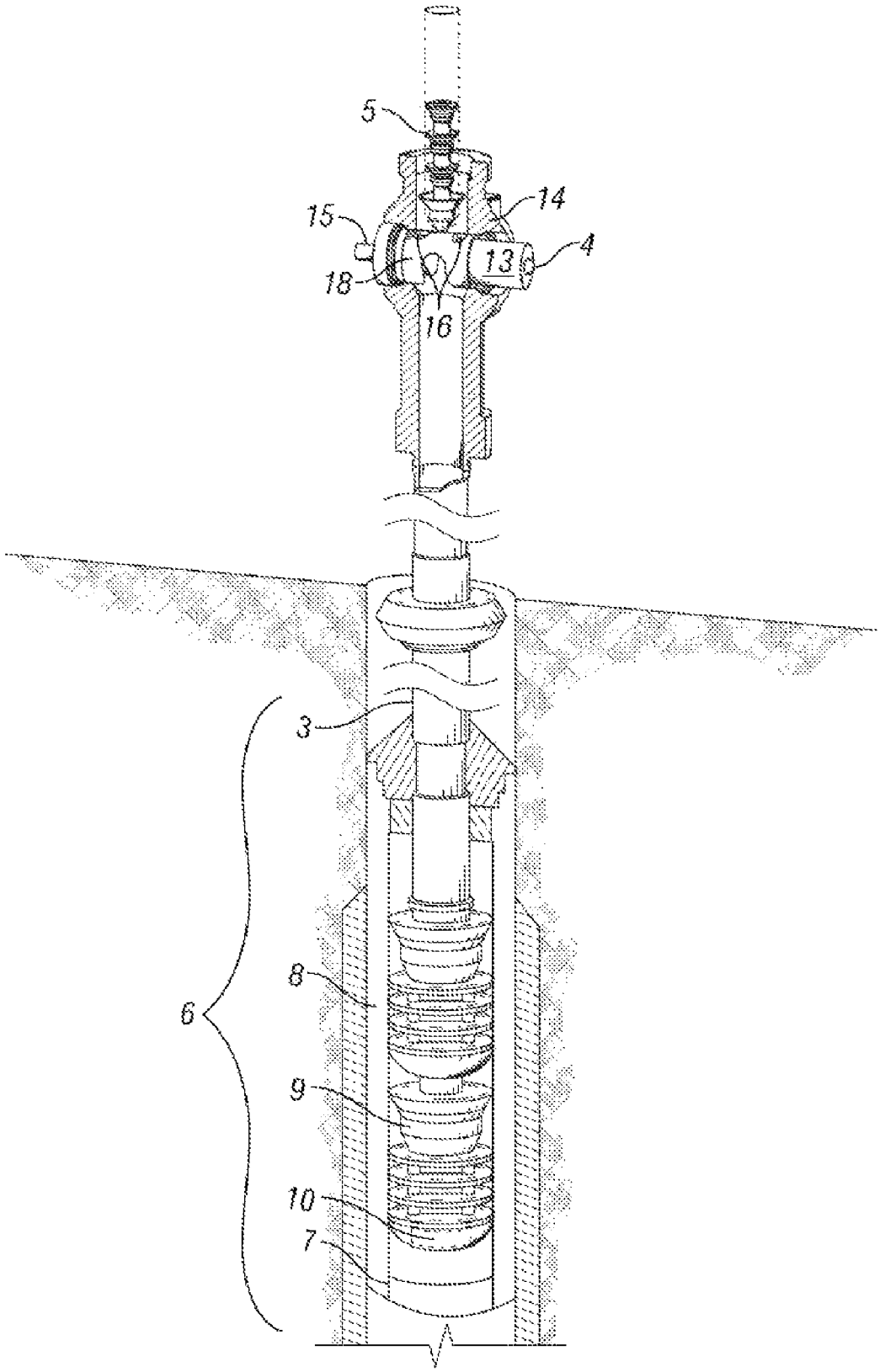
FIG. 2 is a conceptual view of a cementing head plug valve system that allows the release of darts when in the main-flow position, and also allows the release of balls in either the main-flow or bypass-flow position. In this figure the valve is shown in the bypass-flow position. This figure also illustrates how the plug-valve system is installed with respect to the cementing head.
Figure 3:
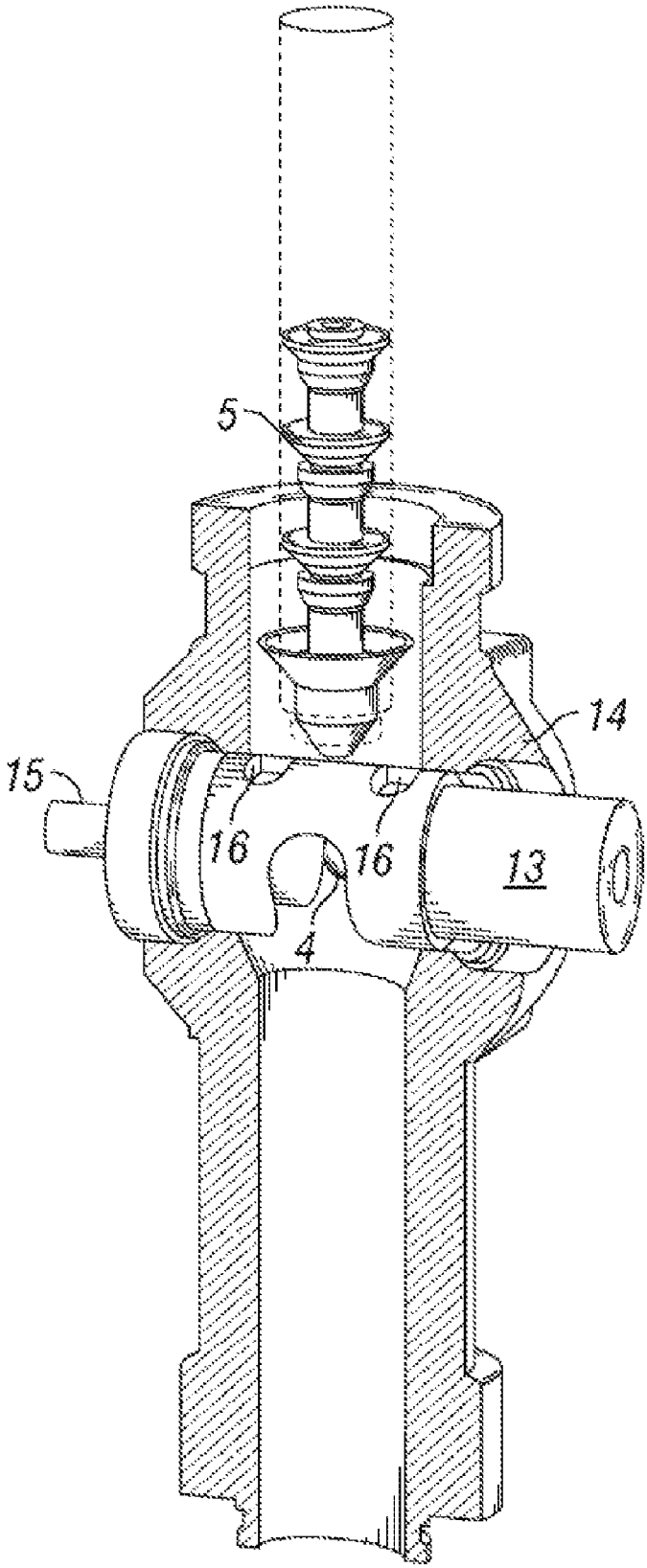
FIG. 3 depicts the ball launching process, whereby a ball is being injected into the well by passing through the axle of the plug valve system.
Figure 4:
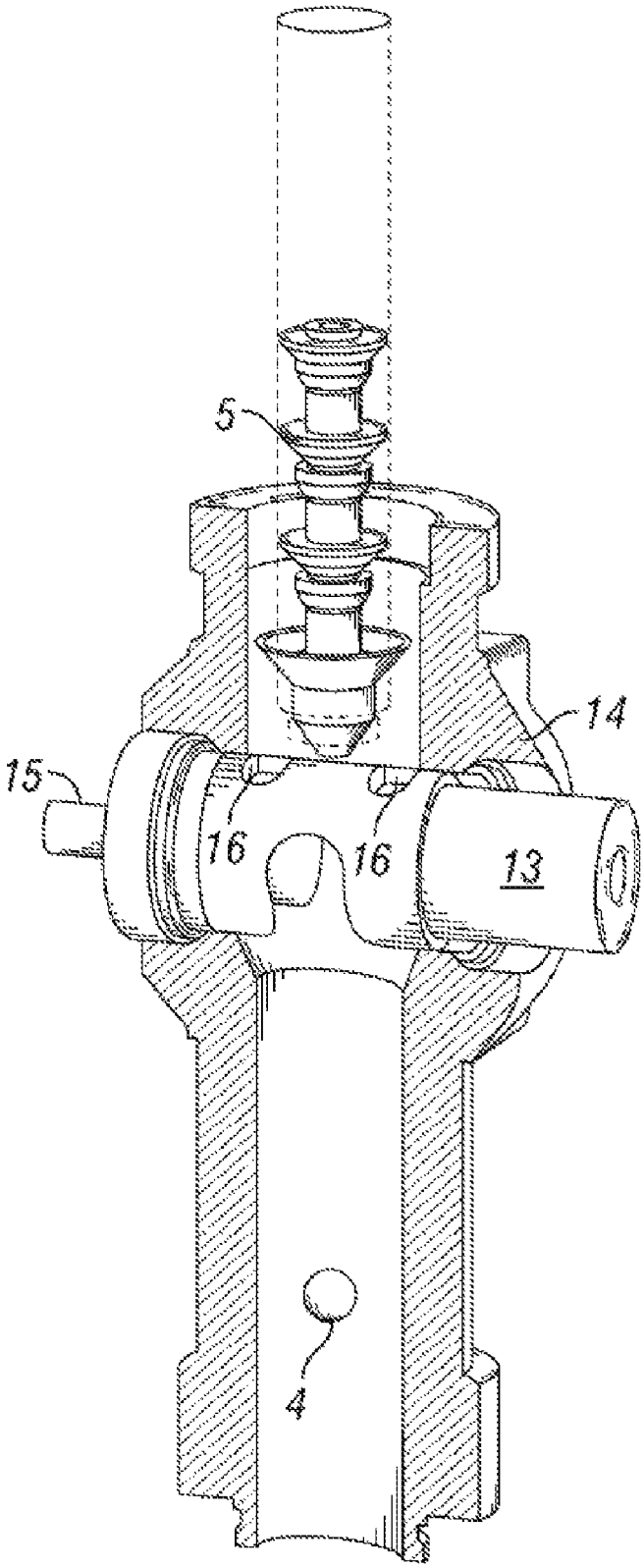
FIG. 4 shows the ball flowing down the wellbore after launching.
Figure 5:
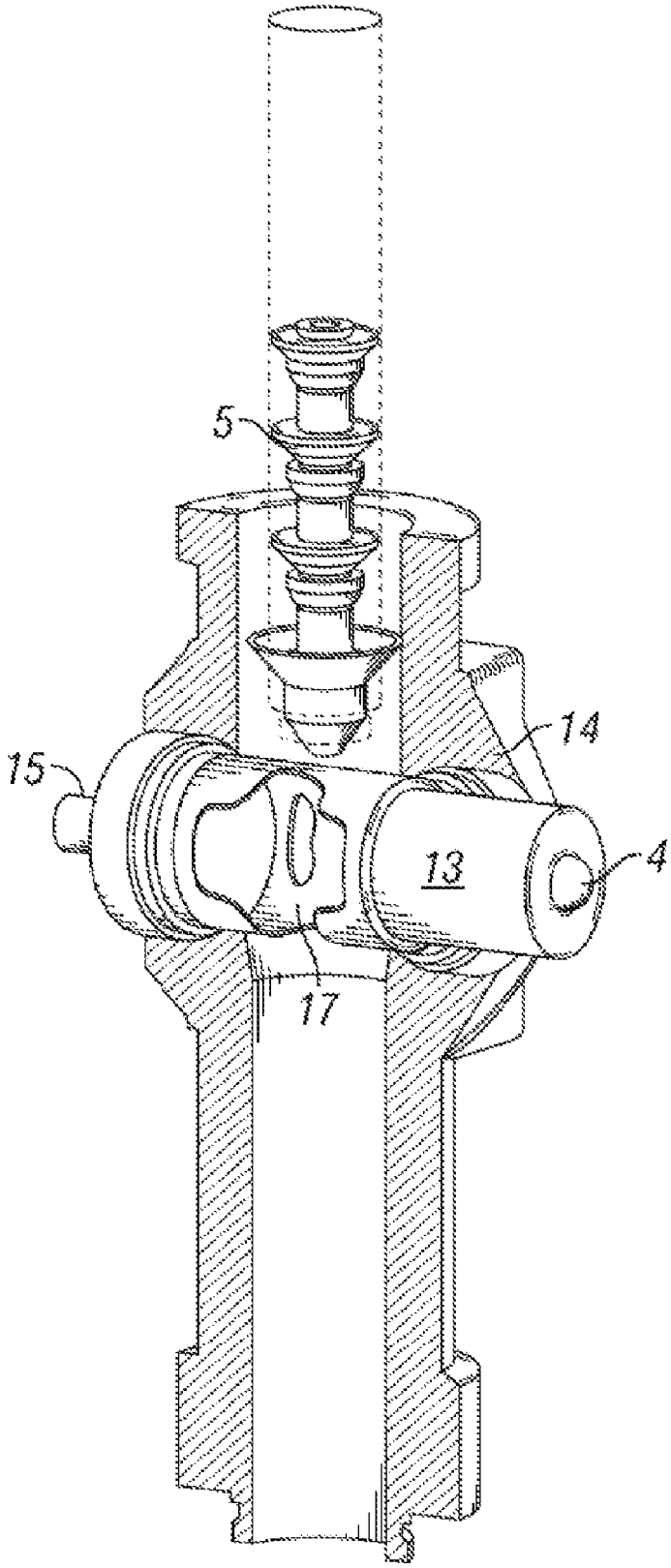
FIG. 5 depicts the dart launching process, whereby the plug valve is rotated into the main-flow position, removing the barrier that previously prevented dart movement. This figure also shows that another ball may be placed into the plug valve axle.

According to a preferred embodiment shown in FIGS. 2-8, the invention involves a plug valve 13 that controls the flow of process fluid through the launcher body 14. The valve rotates around a hollow valve axle 15, directing process-fluid flow through the bypass-flow path 16 (FIG. 2) or through the main-flow path 17 (FIG. 5). Flow is controlled by adjusting the position of the bypass limiter 18 (FIG. 2). FIGS. 2-4 depict the valve in the bypass-flow position. The bypass-flow position prevents movement of the dart 5 through the valve. Instead, at least one launching ball 4 may pass through the hollow valve axle (FIG. 2), into the fluid flow path (FIG. 3) and travel through the casing toward the wiper plugs (FIG. 4).

Figure 6:
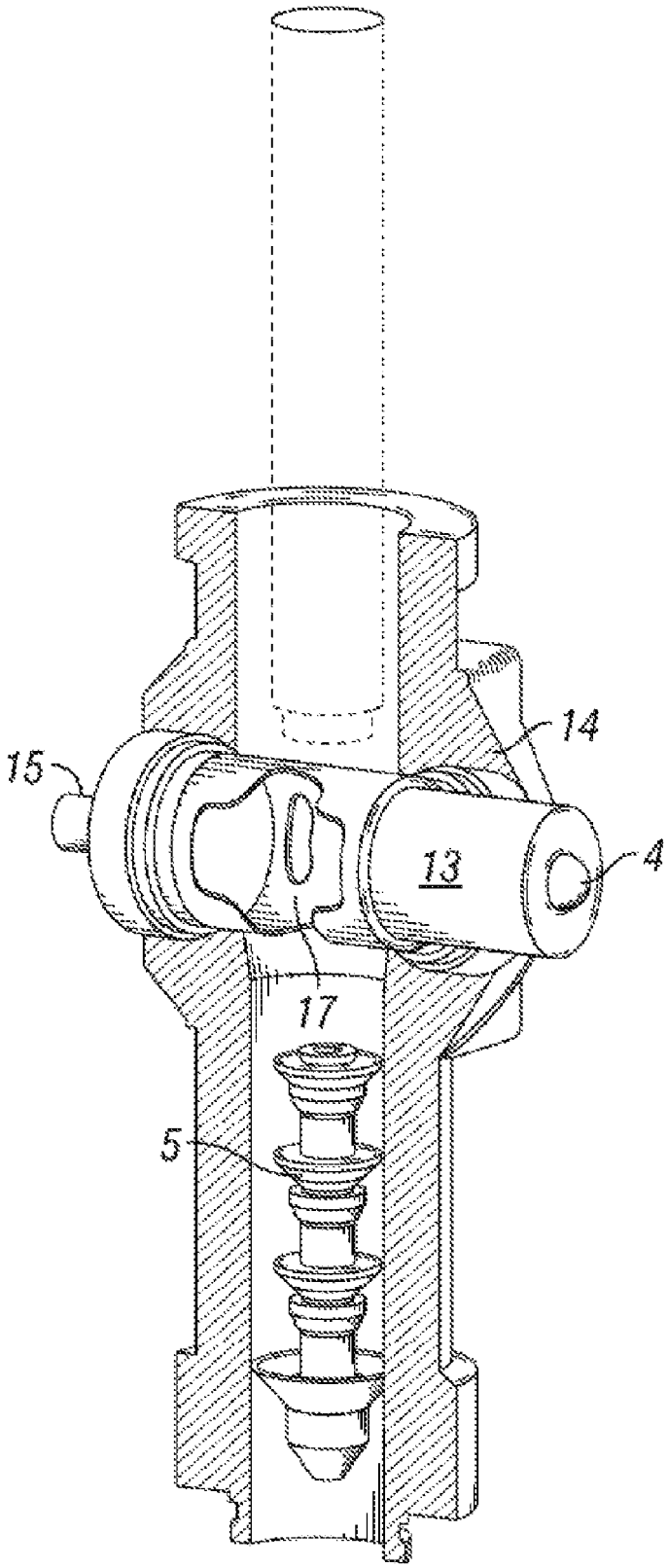
FIG. 6 shows the dart flowing down toward the wellbore after passing through the valve.
Figure 7:
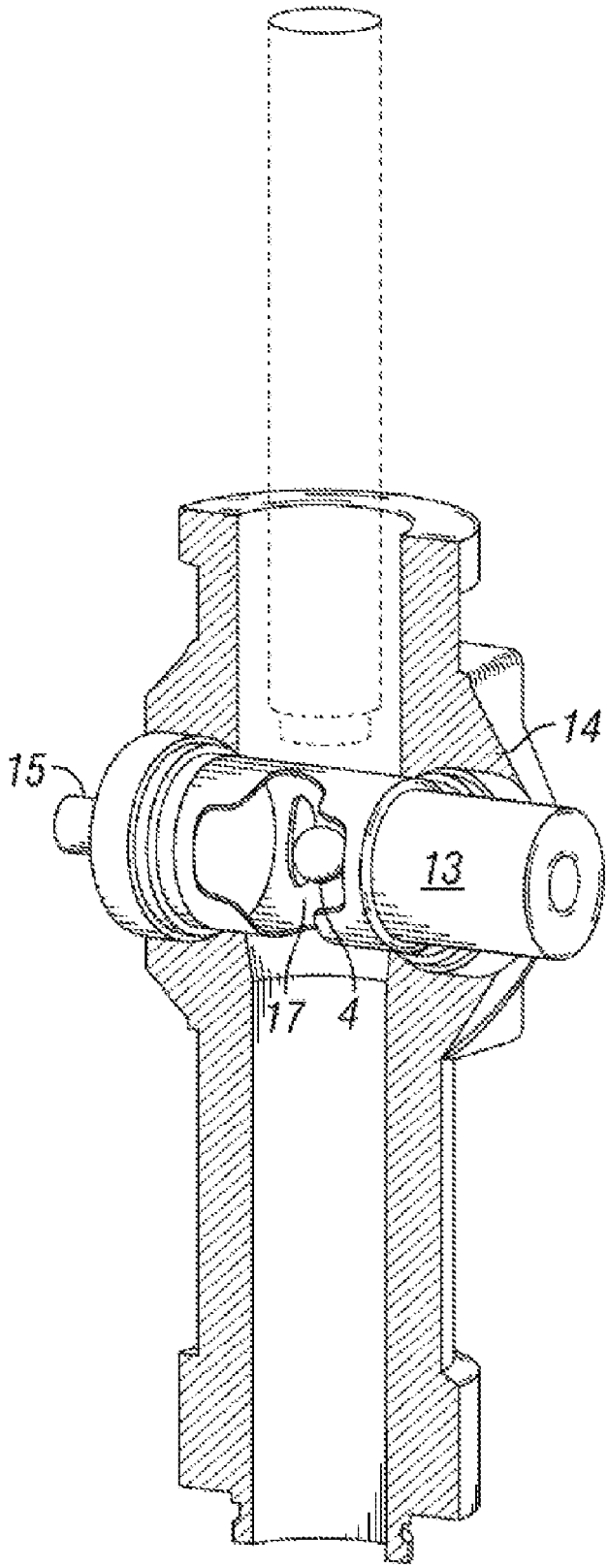
FIG. 7 shows a subsequent ball launching process, with the valve in the main-flow position.
Figure 8:
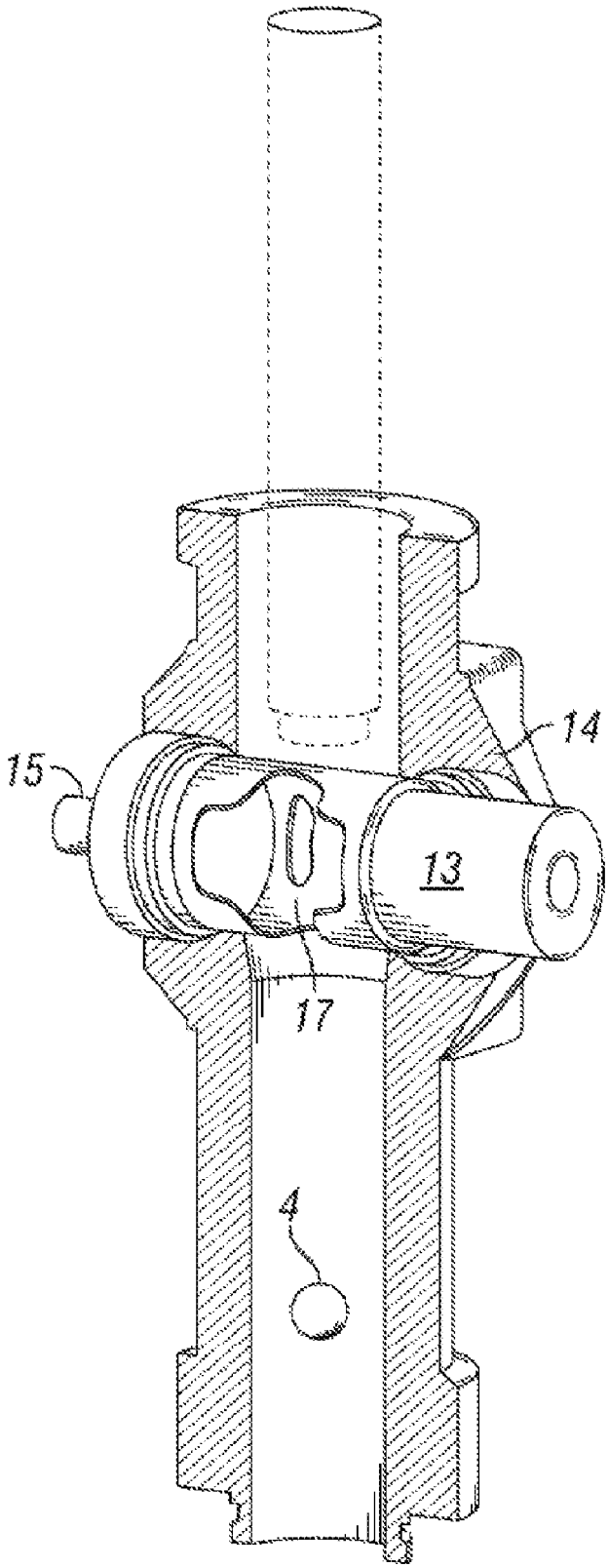
FIG. 8 shows the ball flowing down toward the wellbore after launching.

When it is time to release the dart, the valve rotates to the main-flow position, opening a pathway for the dart (FIG. 5) and allowing it to pass through the valve and continue toward the wiper plugs (FIG. 6). During this period it is also possible to insert another ball inside the valve axle for later release (FIGS. 6-8). Thus, balls may be launched when the plug valve is in either position. The dual functionality of this design reduces the length of the cement-head assembly.

To allow ball deployment in either the main-flow or bypass-flow position, the valve has preferably a swept cutout through at least 90 degrees of the valve's range of motion. In addition, the valve may be fabricated as a hollow shell, allowing a wider berth through which balls may pass, and reducing the probability of their becoming stuck.

In addition to balls and darts, other activation devices such as canisters and bombs may be released by this valve apparatus. The activation devices may also contain chemical substances that, upon exiting the launching chamber, are released into the well.

In a preferred embodiment, the present invention pertains to a method of operating a plug valve 13 and launching activation devices. The method comprises pumping process fluid through the main-flow portion of the launcher body 14 and placing the plug valve in the bypass-flow position. At least one ball 4 may be inserted into the hollow valve axle 15, and then pass through the valve-axle passageway and enter the process-fluid stream. The plug valve may then be placed in the main-flow position, allowing at least one activation device to pass and proceed into the wellbore. While the device is in the main-flow position, one or more balls may be inserted into the hollow valve-axle passageway and launched into the process-fluid stream. The plug valve may then be returned to the bypass-flow position. As before, one or more balls may be launched while the plug valve is in the bypass-flow position. The plug valve may then be reset to the main-flow position, allowing the passage of additional activation devices. This operating sequence may be repeated until a sufficient number of activation devices have been deployed to complete the treatment.

Figure 9:
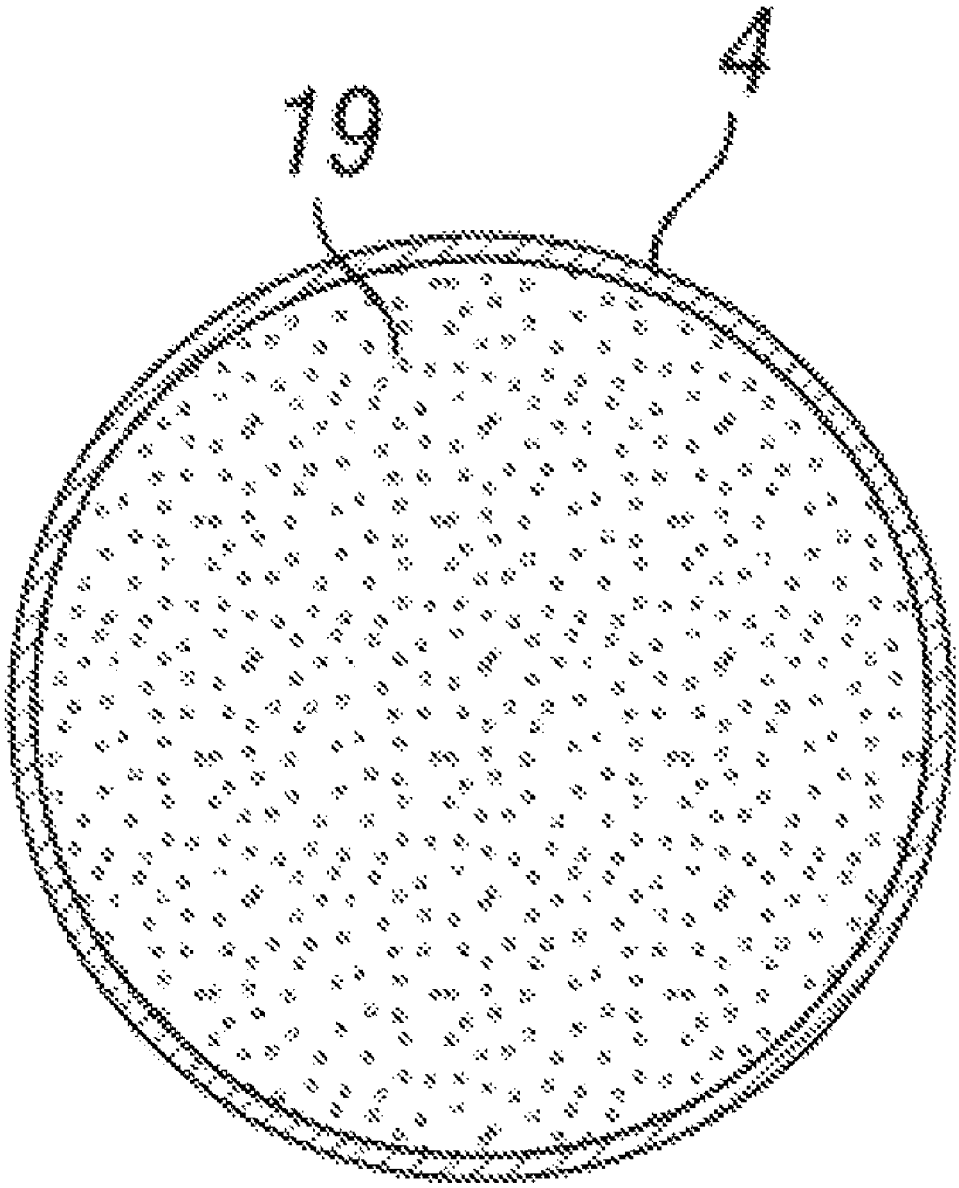
FIG. 9 shows a ball containing a chemical substance.
Figure 10:
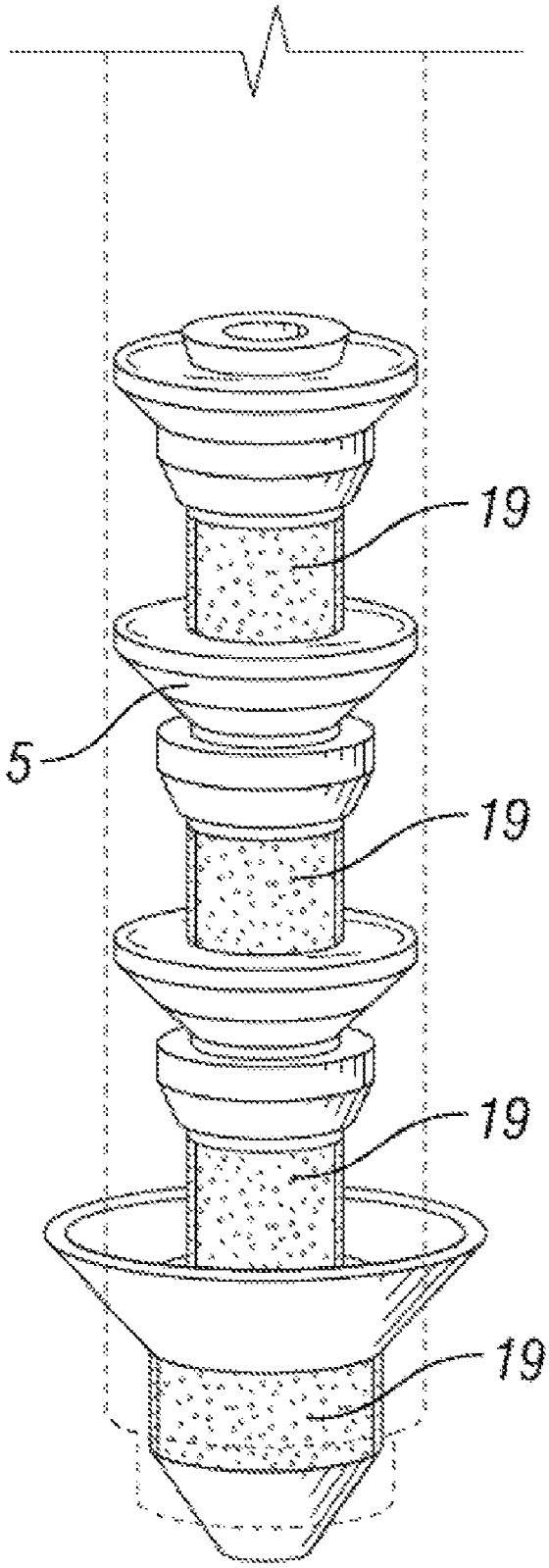
FIG. 10 shows a dart containing a chemical substance.
Figure 11:
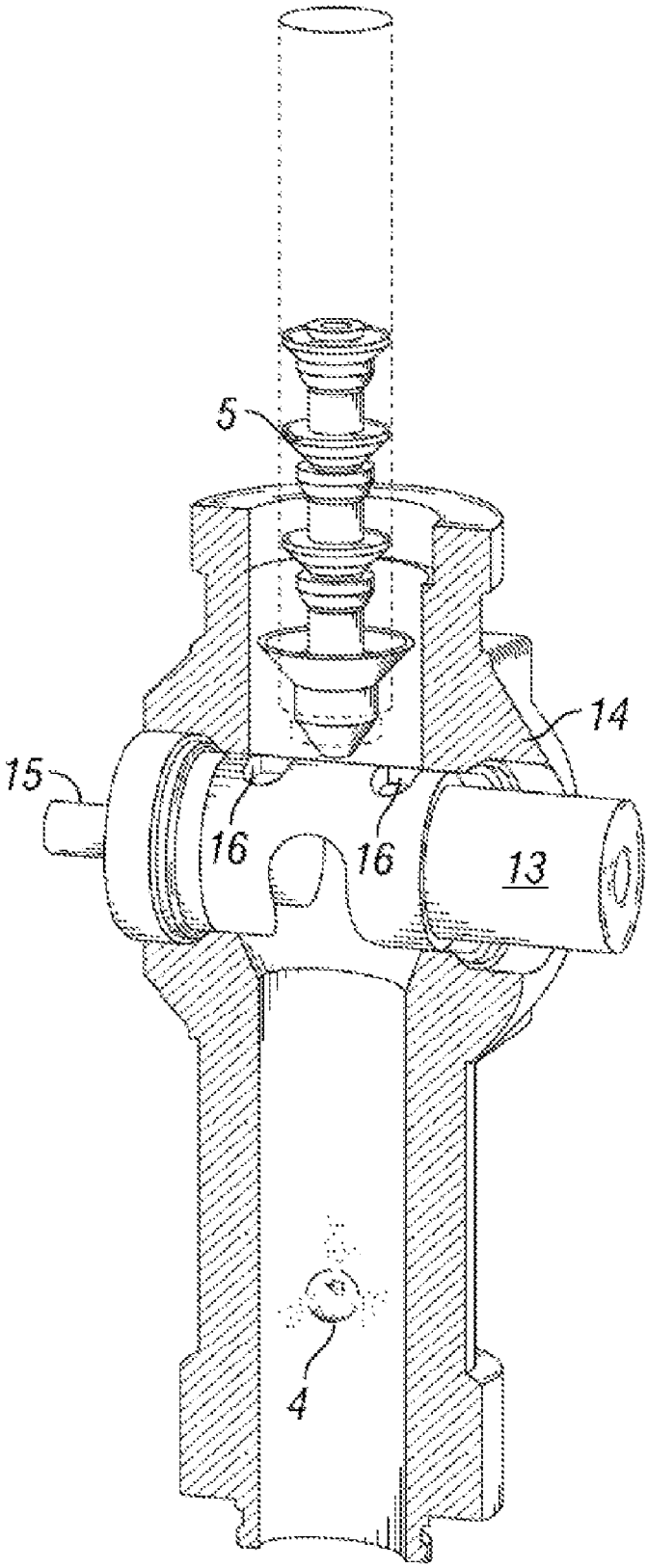
FIG. 11 shows the chemical substance escaping from the ball into the process fluid after launching.
Figure 12:
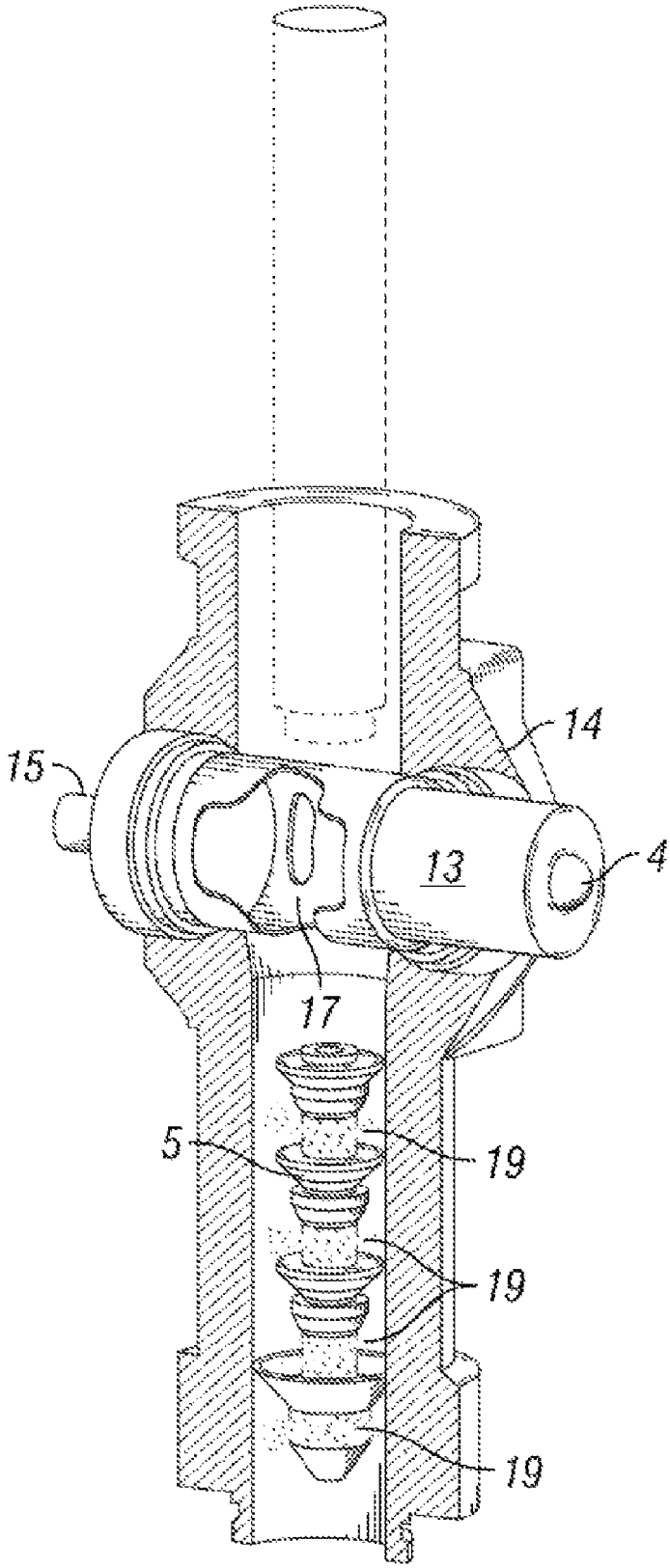
FIG. 12 shows the chemical substance escaping from the dart into the process fluid after launching.

The method of operating the plug valve depicted in FIGS. 2-6 may further comprise activation devices containing a chemical substance that is released after the activation device exits the launching chamber. The activation device may begin dispensing the chemical substance immediately upon launching, or at any time thereafter. FIG. 9 depicts a ball 4 containing a chemical substance 19. Similarly, FIG. 10 depicts a dart 5 containing a chemical substance 19. FIG. 11 shows the chemical substance 19 escaping from the ball 4 into the process-fluid stream after launching. Similarly, FIG. 12 shows the chemical substance 19 escaping from the dart 5 into the process-fluid stream.

In the method of operating the plug valve depicted in FIGS. 2-8, the process fluid may comprise one or more fluids employed in well-service operations. Such fluids include, but are not limited to, drilling fluids, cement slurries, spacer fluids, chemical washes, acidizing fluids, gravel-packing fluids, scale-removal fluids. In addition, the activation devices may comprise darts, balls, bombs and canisters.

It will be appreciated that multiple-stage plug launching systems are also envisioned in the present invention. In addition, the invention is not limited to subsea plug launching systems.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

The invention claimed is:

1. A method for deploying one or more activation devices into a process-fluid stream, utilizing a multiple-activation device launching system for a cementing head, the launching system comprising a plug valve through which activation devices may pass, the plug valve having an axle with a hollow passageway through which balls may be independently launched at any time when the plug valve is in either a main-flow or a bypass-flow position, comprising:

i. pumping process fluid through a main-flow portion of the launching system;

ii. placing the plug valve in the bypass-flow position, inserting at least one ball into the hollow plug-valve axle, and causing the ball to pass through the axle and enter the process-fluid stream;

iii. placing the plug valve in the main-flow position, and allowing at least one activation device to pass, wherein the hollow passageway of the plug-valve axle remains open to the process-fluid stream; and iv. repeating steps ii, and iii, until a sufficient number of activation devices have been deployed to complete a treatment.

2. The method of claim 1, further comprising launching one or more balls into the process-fluid stream during step iii.

3. The method of claim 1, wherein at least one ball, or at least one activation device, or both, contains a chemical substance whose release into the process fluid does not commence immediately after deployment into the process-fluid stream.

4. The method of claim 1, wherein the process fluid comprises one or more fluids chosen from the list-consisting of: drilling fluids, cement slurries, spacer fluids, chemical washes, acidizing fluids, gravel-packing fluids and scale-removal fluids.

5. The method of claim 1, wherein the activation-devices comprise one or more members of the list-consisting of: darts, balls, canisters and bombs.

6. The method of claim 1, wherein the valve is a hollow shell.

7. The method of claim 1, wherein the plug valve has a swept cutout through at least 90 degrees of the valve's range of motion.

* * * * *